US007052245B2

(12) United States Patent
Lilie et al.

(10) Patent No.: US 7,052,245 B2
(45) Date of Patent: May 30, 2006

(54) OIL PUMPING SYSTEM FOR A RECIPROCATING HERMETIC COMPRESSOR

(75) Inventors: Dietmar Erich Bernhard Lilie, Joinville (BR); Ingwald Vollrath, Joinville (BR); Egidio Berwanger, Joinville (BR); Rinaldo Puff, Joinville (BR)

(73) Assignee: Empresa Brasileira De Compressores S.A. -Embraco, Joinville -SC (BR)

( * ) Notice: Subject to any disclaimer, the term of this patent is extended or adjusted under 35 U.S.C. 154(b) by 277 days.

(21) Appl. No.: 10/474,390

(22) PCT Filed: Apr. 4, 2002

(86) PCT No.: PCT/BR02/00049

§ 371 (c)(1),
(2), (4) Date: Mar. 11, 2004

(87) PCT Pub. No.: WO02/081916

PCT Pub. Date: Oct. 17, 2002

(65) Prior Publication Data

US 2004/0156732 A1 Aug. 12, 2004

(30) Foreign Application Priority Data

Apr. 5, 2001 (BR) ..... 0101757

(51) Int. Cl.
*F04B 19/00* (2006.01)
*F04B 53/00* (2006.01)

(52) U.S. Cl. ..... 417/211; 417/61; 417/417

(58) Field of Classification Search ..... 417/415, 417/416, 417, 902, 61, 211; 184/6.28, 26, 184/32; 92/163, 128
See application file for complete search history.

(56) References Cited

U.S. PATENT DOCUMENTS

| | | | | |
|---|---|---|---|---|
| 2,865,559 | A | 12/1958 | Gigler | |
| 3,814,550 | A | 6/1974 | Adams | |
| 6,644,945 | B1 * | 11/2003 | Lilie et al. | 417/571 |
| 6,663,351 | B1 * | 12/2003 | Joo | 417/53 |
| 6,676,388 | B1 * | 1/2004 | Lee et al. | 417/417 |

FOREIGN PATENT DOCUMENTS

| | | | |
|---|---|---|---|
| DE | 199 21 293 | A1 | 12/1999 |
| GB | 759345 | A1 | 10/1956 |
| JP | 9-195938 | A1 | 7/1997 |
| JP | 2001-82326 | A1 | 3/2001 |
| WO | WO-97/01032 | A1 | 1/1997 |
| WO | WO-97/01033 | A1 | 1/1997 |
| WO | WO-02/20990 | A1 | 3/2002 |

* cited by examiner

*Primary Examiner*—Charles G. Freay
*Assistant Examiner*—Vikansha Dwivedi
(74) *Attorney, Agent, or Firm*—Darby & Darby

(57) ABSTRACT

An oil pumping system for a reciprocating hermetic compressor having a shell, which defines in the interior thereof an oil sump; a motor compressor assembly; and an oil pump means. The oil pump means is coupled to the compressor by at least one dampening resilient means. The dampening resilient means is dimension to reduce the amplitude of displacement of the oil pump means to a value that is calculated so that the ratio between the natural frequency of resonance (Wn) of the oil pump means and an operation frequency (W) of the compressor results in a ratio between the displacements of the oil pump means and of the compressor with a value inferior to one.

11 Claims, 2 Drawing Sheets

OIL PUMPING SYSTEM FOR A RECIPROCATING HERMETIC COMPRESSOR

CROSS-REFERENCE TO PRIOR APPLICATIONS

This is a U.S. National Phase application under 35 U.S.C. § 371 of International Patent Application No. PCT/BR02/00049 filed Apr. 4, 2002, and claims the benefit of Brazilan Patent Application No. PI 0101757-8 filed Apr. 5, 2001, both of which are incorporated by reference herein. The International Application was published in English on Oct. 17, 2002 as WO 2002/081916 A1 under PCT Article 21(2).

FIELD OF THE INVENTION

The present invention refers to an oil pumping system for a reciprocating hermetic compressor, particularly of the type driven by a linear motor and used in small refrigeration appliances, such as refrigerators, freezers, water fountains, etc., to be applied, for example, to an oil pump of the type described in the co-pending Brazilian patent application PI0004286.2 (PCT/BR01/00113) of the same applicant.

BACKGROUND OF THE INVENTION

In hermetic compressors for commercial and domestic refrigeration, an important factor for the correct operation thereof is the adequate lubrication of the components that move relatively to each other. The difficulty in obtaining such lubrication is associated to the fact that the oil must flow upwardly to lubricate said parts with relative movement. Among the known solutions for obtaining such lubrication, there is one that uses the principles of centrifugal force and that of mechanical drag.

In one of these solutions, which is used both in the linear compressors and the reciprocating compressors, in order to supply oil to the piston/cylinder assembly, it is necessary to make the gas flow, from the compressor suction and which generates a small pressure differential in relation to the oil sump, draw said oil through a capillary tube, mixing it with the gas drawn by the compressor, said mixture being admitted to the inside of the cylinder by the suction valve, so that the oil lubricates the contact parts between the piston and the cylinder. As a function of the low gas flow that is drawn by the compressor in certain situations, this construction is not always efficient.

In other known construction (WO97/01033), the compression and suction forces of the piston are used to displace the lubricant oil from the oil sump formed in a lower portion of the compressor shell, to an upper reservoir formed around the cylinder of said compressor, through a capillary tube, said upper reservoir being connected to the inside of the cylinder by a plurality of orifices formed in the wall thereof and which serve for admitting oil to the interior of the piston-cylinder gap when the piston is performing the suction movement, and for discharging said oil when the piston is performing the reverse movement. The oil is discharged to a set of channels formed in the valve plate of the compressor, further increasing the suction flow and making said oil re-enter into the cylinder.

Other known solution (WO 97/01032) uses a resonant mass that reciprocates inside a cavity formed on the external side of the cylinder, said resonant mass drawing oil from the sump while moving in one direction, said oil passing through a tube and through a check valve that allows only the admission of oil into said cavity, the latter being connected to the inside of the cylinder by a plurality of orifices formed in the wall thereof. The oil of said cavity is expelled when the resonant mass moves in the other direction and passes through a check valve that allows only the discharge of oil from said cavity. Although being functional, this solution is difficult to manufacture and its construction has many components.

In the above cited patent application PI0004286 of the same applicant, there is disclosed an oil pump means that is driven by the reciprocating movement of either the piston or the cylinder, said oil pump means being formed by a plunger, inside which is provided a movable seal that is displaceable between a closing position, in which it is seated against a valve seat located adjacent to an oil inlet orifice defined in the body of the oil pump means, and an opening position, in which said seal is moved away from the valve seat, said positions being axially spaced from each other, a maximum spacing being obtained, for example, when the seal reaches a stop provided inside the body of said oil pump means. When the oil pump moves in a determined direction and sense (as illustrated in FIG. 1), the seal is displaced towards the stop, allowing said oil to enter through the inlet orifice and pushing the column of oil in the opposite direction to the movement of said oil pump means. When the oil pump moves in the opposite direction to that described above, as indicated in FIG. 2, the seal moves towards the valve seat, blocking the entrance of oil to the inside of the body of the oil pump means and avoiding the admitted oil from coming out through the inlet orifice. Thus, with the continuous reciprocation of the oil pump means, the oil is continuously admitted and impelled through the body of the oil pump means towards the movable parts of the compressor to be lubricated.

In the linear compressors, said oil pump means is mounted in the same direction of movement as the resonant assembly. Such movement makes the mechanical assembly, which is placed on a suspension system, have a reciprocating movement to drive the oil pump means. The above solution uses the reciprocation of one of the resonant assembly and non-resonant assembly of the compressor to impel, by inertia, the oil supply to the oil pump means and from the latter to the movable parts of the compressor requiring lubrication.

Nevertheless, the reciprocating movements in the compressors driven by a linear motor are known to generally have great amplitudes.

Moreover, in the particular construction of the oil pump means of said patent application PI0004286.2, great amplitudes of oscillation lead to the occurrence of strong shocks of the seal of said oil pump means against the stop to the displacement thereof and against the valve seat of the oil pump means, causing damage to these components with the continuous operation of the compressor, which impairs the reliability of said compressor and increases the levels of noise during its operation.

OBJECTS OF THE INVENTION

Thus, it is an object of the present invention to provide an oil pumping system for a reciprocating hermetic compressor, which allows controlling the amplitude of the oscillating movements of the oil pump, maintaining said amplitude substantially unaltered, independently of the amplitude of the oscillating movements during operation of the compressor.

Another object of the present invention is to provide an oil pumping system of the type cited above, which is easy to manufacture and allows achieving a proper lubrication of the parts of the compressor with relative movement, without the low effectiveness and the reduced reliability of the known prior art techniques, avoiding damages to the component parts of the oil pump means and the increase of noise levels during operation of the compressor.

SUMMARY OF THE INVENTION

This and other objects are achieved by an oil pumping system for a reciprocating hermetic compressor presenting a shell, which defines in the interior thereof an oil sump; a motor-compressor assembly; and an oil pump means that is coupled to the compressor to be displaced in a reciprocating movement in a determined direction; and a fluid communication means connecting the oil pump means to the parts of the compressor to be lubricated, the oil pump means being coupled to the compressor by at least one dampening resilient means that is dimensioned to reduce the amplitude of displacement of said oil pump means to a value that is calculated so that the ratio between the natural frequency of resonance of said oil pump means and an operation frequency of the compressor results in a ratio between the displacements of the oil pump means and of said compressor with a value inferior to one.

BRIEF DESCRIPTION OF THE DRAWINGS

The invention will be described below, with reference to the attached drawings, in which.

DESCRIPTION OF THE ILLUSTRATED EMBODIMENTS

Figure 1:
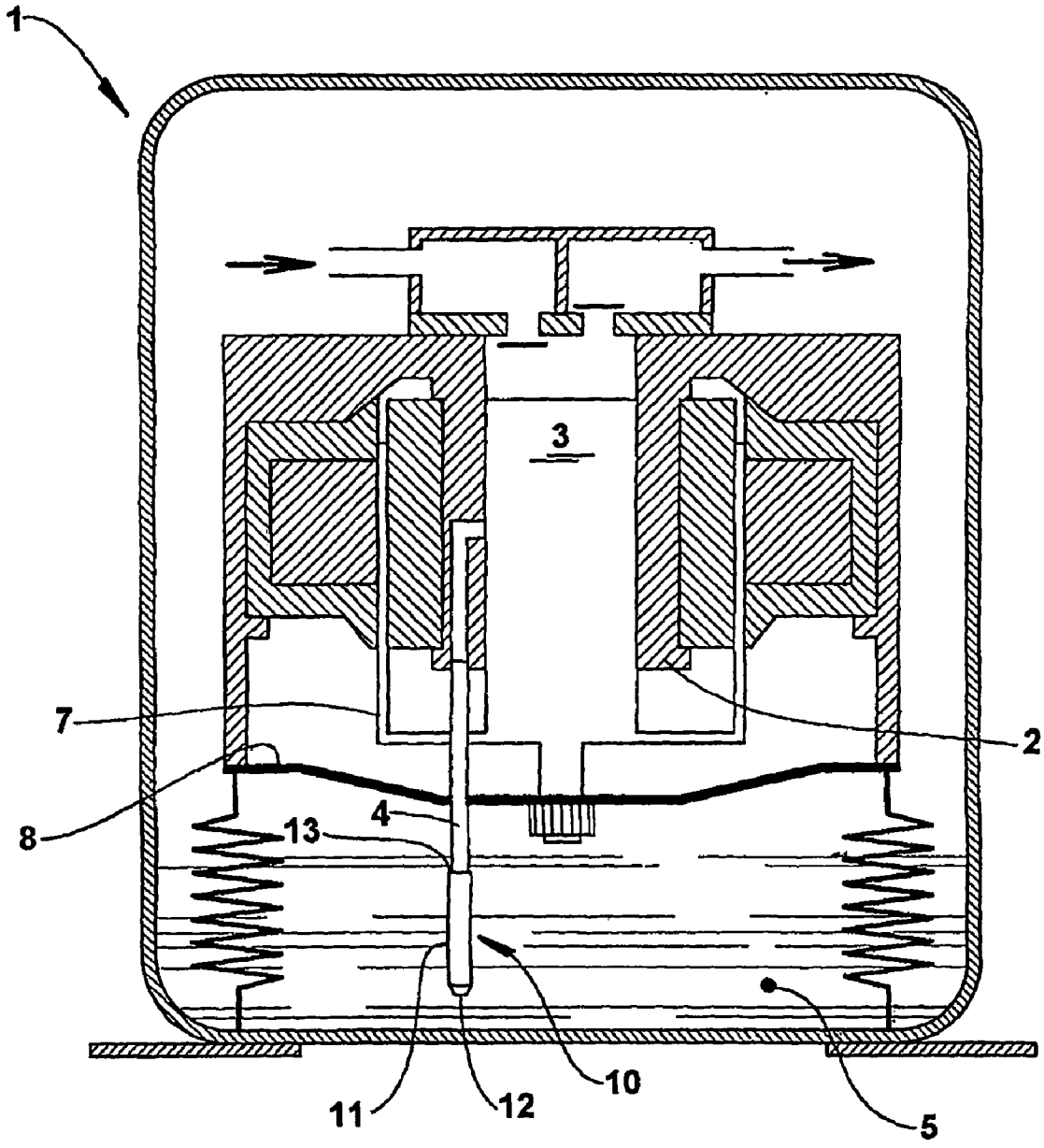
FIG.1 PRIOR ART
FIG. 1 is a schematic longitudinal diametrical sectional view of part of a reciprocating hermetic compressor with a linear motor, having a piston with a vertical axis and an oil pump means constructed according to the prior art described in said patent application PI0004286.2.
Figure 2A:
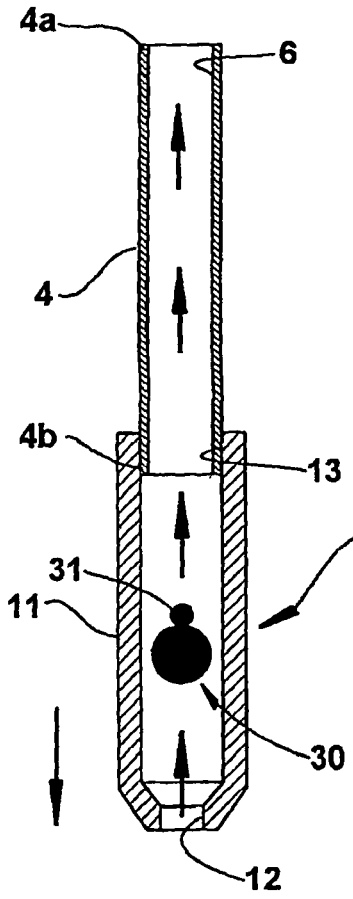
FIG.2a PRIOR ART
FIGS. 2*a* and 2*b* illustrate, schematically, the operation of an oil pump means, such as that illustrated in FIG. 1.
Figure 2B:
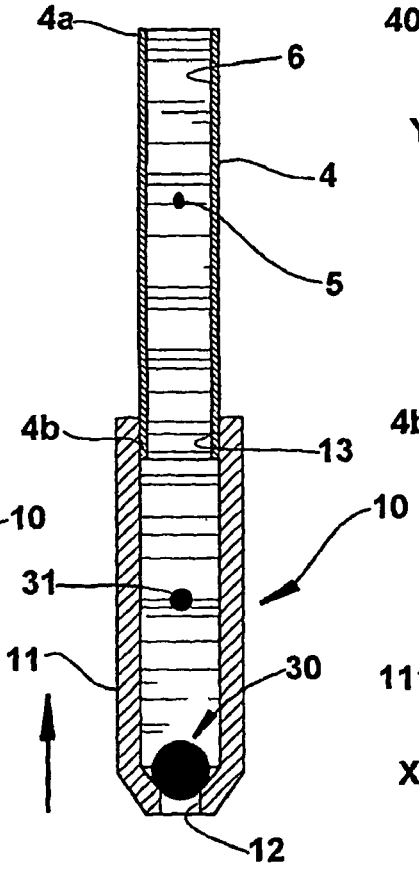
FIG.2b PRIOR ART

The present invention will be described in relation to a reciprocating hermetic compressor (for example of the type applied to a refrigeration system) having a shell 1 lodging a cylinder 2, inside which reciprocates a piston 3 coupled to a driving mechanism through a connecting rod 4, which is defined for example by a piston rod, inside the shell 1 being defined an oil sump 5, wherefrom the lubricant oil is pumped by an oil pump means 10 to the movable parts of the compressor to be lubricated. The oil pumping system in question comprises a fluid communication means 6 coupling the oil pump means 10 to said parts of the compressor to be lubricated, in order to take to said parts the lubricant oil from the oil sump 5. In the reciprocating hermetic compressor with a linear motor, the reciprocation of the piston 3 is effected by means of an actuator 7 carrying a magnetic component and driven by the linear motor.

The piston 3 is connected to a resonant spring 8, for example by its connecting rod, and forms, together with the magnetic component, the resonant assembly of the compressor. The non-resonant assembly of the compressor comprises the cylinder 2, a suction and discharge system of the compressor and its linear motor.

In a constructive option as illustrated, the oil pump means 10 is impelled by the resonant mass of the compressor and oscillates, for example in the reciprocation direction of the piston 3. In another known construction of the oil pump means (not illustrated), the latter is placed so as to be impelled by the non-resonant mass of the compressor or by the movement of the latter during operation, when said compressor vibrates as a function of the mutual reaction of the resonance forces that are related to the oscillating masses in said compressor, with an amplitude of oscillation that is a function of the proportion between the masses of the piston 3 (and aggregated parts) and the mass of the compressor.

In the constructions in which the oil pump means 10 is mounted to the piston 3, motion of the latter can provoke displacements of said oil pump means 10 with much greater amplitudes (about three times greater) than those obtained when said oil pump means 10 is attached, for example to the cylinder 2, resulting in the inconveniences already discussed above.

According to the illustrations, the oil pump 10 comprises a tubular pump body 11, having an oil inlet end 12 that is opened to the oil sump 5, for example immersed in the oil, and an oil outlet end 13 that is connected to the fluid communication means 6.

Figure 3:
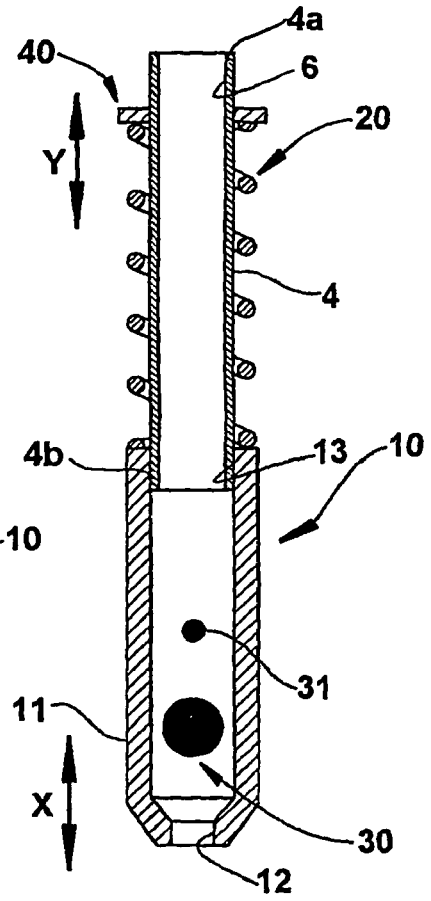
FIG. 3 illustrate, schematically and in a longitudinal sectional view, the construction of the oil pump shown in FIG. 2*a* and provided with the improvement of the present invention illustrated in FIG. 1.

According to the present invention, the oil pump means 10 is coupled to the compressor by at least one dampening resilient means 20, such as a helical spring, which is dimensioned to reduce the amplitude of the displacement of said oil pump means 10 to a value that is calculated so that the ratio between the natural frequency of resonance of said oil pump means 10 and an operation frequency of the compressor results in a ratio between the displacements of both the oil pump means 10 and the compressor with a value lower than one. In order that the dampening resilient means 20 of the present invention operates to reduce the operation amplitude of the oil pump means 10 to a desired value, said dampening resilient means 20 should present a determined elastic constant K, which is calculated so that the ratio between the natural frequency of resonance Wn thereof and the operation frequency W of the compressor results in a ratio between the displacement X of the oil pump means 10 and the displacement Y of the compressor with a value lower than one. Such ratio is achieved by the equation $Wn=(K/Mb)^{(1/2)}$, where Mb is the mass of the oil pump means 10. In FIG. 3, there are indicated the direction and the sense of each of the displacements: of the pump means (indicated by X) and of the compressor (indicated by Y).

Figure 4:
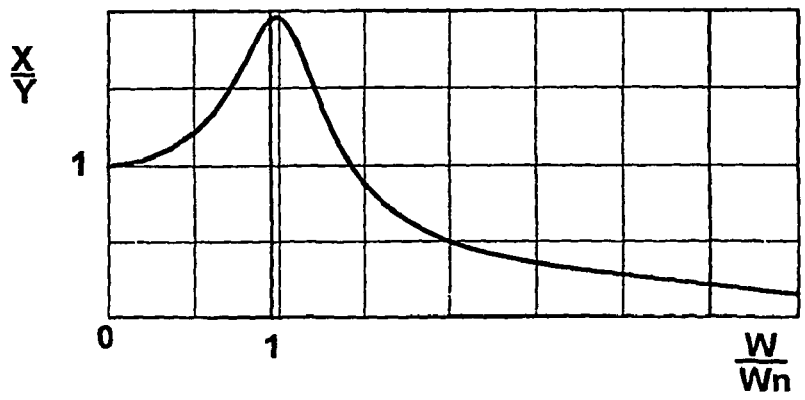
FIG. 4 represents, graphically, the variation of the ratio of the oscillating displacement of an oil pump means and of the compressor, in relation to the ratio between the operation frequency (W) of the compressor and the natural frequency of resonance (Wn) of the dampening resilient means of the improvement of the present invention.

The ratio of the reduction of the amplitude of the movement of the oil pump means 10 in relation to the amplitude of the movement of the tube X/Y can be defined by defining the value of the natural frequency of resonance Wn in relation to the operation frequency of the compressor W, with a determined ratio (K/Mb) between the elastic constant K of the dampening resilient means 20 and the mass Mb of the oil pump means 10, as illustrated in FIG. 4. This graph presents, schematically, the ratio between the displacements of the oil pump means 10 and of the connecting rod 4, as a function of the ratio W/Wn, and the region where the reduction in the amplitude of movement is achieved is indicated by X/Y<1, where X is the amplitude of movement of the oil pump means 10 and Y is the amplitude of movement of said connecting rod 4.

According to the present invention, the connecting rod 4 has a first end 4*a*, coupled to the compressor, and an opposite end 4*b*, opposite to the first end 4*a* and coupled to the oil pump means 10, said connecting rod 4 being telescopically coupled to at least one of the compressor and the oil pump means 10 and at least one of said couplings being achieved through the dampening resilient means 20.

In the construction illustrated herein, the connecting rod 4 is hollow and defines, internally, part of the fluid communication means 6 between the oil pump means 10 and the parts of the compressor to be lubricated, and the dampening resilient means 20 is mounted around the end of said connecting rod 4, to which end the oil pump means 10 is externally coupled, the dampening resilient means 20 being external to said oil pump means 10.

In another embodiment of the present solution, not illustrated, the connecting rod 4 carries, internally, at its end adjacent to the oil sump 5, the oil pump means 10, and the dampening resilient means 20 is provided internal to said connecting rod 4, external to the oil pump means 10.

According to the present invention, the oil pump means 10 has, between its oil inlet end 12 and its oil outlet end 13, at least one check valve 30, for example in the form of a movable sealing means, such as that described in said patent application PI0004286.2, and which is displaced between a valve seat defined at the inlet end 12 of the pump body 11 of the oil pump means 10 and an internal stop 31.

In another construction for the check valve 30, the latter is provided in at least one of the oil inlet end 12 and the oil outlet end 13 of the oil pump means 10, or in a region of the pump body 11 between said oil inlet and outlet ends 12, 13.

The present pumping system further foresees at least one stop 40, for instance mounted to the connecting rod 4 between the oil pump means 10 and the compressor, for limiting the maximum displacement of the dampening resilient means 20.

The invention is claimed is:

1. An oil pumping system for a reciprocating hermetic compressor comprising:

a shell, which defines in the interior thereof an oil sump;

a motor-compressor assembly; and an oil pump means that is coupled to the compressor to be displaced in a reciprocating movement in a determined direction; and a fluid communication means connecting the oil pump means to the parts of the compressor to be lubricated, wherein the oil pump means is coupled to the compressor by at least one dampening resilient means that is dimensioned to reduce the amplitude of displacement of said oil pump means to a value that is calculated so that the ratio between the natural frequency of resonance (Wn) of said oil pump means and an operation frequency (W) of the compressor results in a ratio between the displacements of the oil pump means and of said compressor with a value inferior to one.

2. An oil pumping system, according to claim 1, further comprising a connecting rod having an end coupled to the compressor and an opposite end coupled to the oil pump means, at least one of said couplings being achieved by the dampening resilient means.

3. An oil pumping system, according to claim 2, wherein the connecting rod is telescopically coupled to at least one of the compressor and the oil pump means .

4. An oil pumping system, according to claim 3, wherein the connecting rod is hollow and defines part of the fluid communication means between the oil pump means and the parts of the compressor to be lubricated.

5. An oil pumping system, according to claim 4, wherein the connecting rod carries, externally, at a respective first end, the oil pump means, the dampening resilient means being mounted around said first end, external to said oil pump means.

6. An oil pumping system, according to claim 4, wherein the connecting rod carries, internally, at its first end, the oil pump means, and the dampening resilient means is provided internal to said connecting rod, external to said oil pump means.

7. An oil pumping system, according to claim 4 wherein the motor-compressor assembly comprises a piston coupled to a driving mechanism through a rod of the piston, characterized in that the connecting rod is a piston rod.

8. An oil pumping system, according to claim 1, wherein the dampening resilient means is in the form of a helical spring.

9. An oil pumping system, according to claim 1, further comprises at least one check valve provided in the oil pump means.

10. An oil pumping system, according to claim 9, wherein the oil pump means has one oil inlet end opened to the oil sump, and an oil outlet end, opened to the first end of the connecting rod, said check valve being provided in at least one of said oil inlet end and oil outlet end of the oil pump means.

11. An oil pumping system, according to claim 10, wherein the connecting rod has at least one stop for limiting the maximum displacement of the dampening resilient means.

* * * * *

UNITED STATES PATENT AND TRADEMARK OFFICE

CERTIFICATE OF CORRECTION

PATENT NO. : 7,052,245 B2
APPLICATION NO. : 10/474390
DATED : May 30, 2006
INVENTOR(S) : Dietmar Erich Bernhard Lilie et al.

It is certified that error appears in the above-identified patent and that said Letters Patent is hereby corrected as shown below:

In the Filing Date: On Title Page,

Please delete "March 11, 2004" and substitute with -- November 11, 2003 --.

Signed and Sealed this

Twenty-first Day of November, 2006

JON W. DUDAS
*Director of the United States Patent and Trademark Office*